US009210490B2

(12) United States Patent
Lemarquand

(10) Patent No.: US 9,210,490 B2
(45) Date of Patent: Dec. 8, 2015

(54) HIGH FIDELTY ELECTRO-ACOUSTIC ENCLOSURE AND METHOD OF MANUFACTURE

(75) Inventor: Guy Lemarquand, Beduer (FR)

(73) Assignee: Daniel Dumay, Savignon (FR)

( * ) Notice: Subject to any disclaimer, the term of this patent is extended or adjusted under 35 U.S.C. 154(b) by 143 days.

(21) Appl. No.: 13/988,923

(22) PCT Filed: Nov. 22, 2011

(86) PCT No.: PCT/FR2011/000585

§ 371 (c)(1),
(2), (4) Date: Oct. 24, 2013

(87) PCT Pub. No.: WO2012/069708

PCT Pub. Date: May 31, 2012

(65) Prior Publication Data

US 2014/0044299 A1 Feb. 13, 2014

(30) Foreign Application Priority Data

Nov. 23, 2010 (FR) ..... 10 04547

(51) Int. Cl.

| | |
|---|---|
| ***H04R 1/02*** | (2006.01) |
| ***H04R 1/28*** | (2006.01) |
| *A47B 81/06* | (2006.01) |

(52) U.S. Cl.

CPC ..... *H04R 1/02* (2013.01); *H04R 1/2884* (2013.01)

(58) Field of Classification Search

CPC ..... H04R 1/02; H04R 1/025; H04R 1/28; H04R 1/2869; H04R 1/2884; H04R 1/2892

USPC ..... 381/386, 335, 345, 349, 348, 347, 350, 381/352, 353; 181/198, 148, 150, 153, 156, 181/155

See application file for complete search history.

(56) References Cited

U.S. PATENT DOCUMENTS 2,881,850 A * 4/1959 Bonn ..... 181/153
3,473,525 A 10/1969 Heisrath (Continued)

FOREIGN PATENT DOCUMENTS

DE 8629084 U1 4/1987
DE 3820244 C1 8/1989

(Continued)

OTHER PUBLICATIONS

International Search Report dated Mar. 23, 2012, as issued in corresponding International Patent Application No. PCT/FR2011/000585-8 pages (with English translation).

(Continued)

*Primary Examiner* — Sunita Joshi
(74) *Attorney, Agent, or Firm* — Maier & Maier, PLLC

(57) ABSTRACT

The invention relates to an electro-acoustic to enclosure (10) comprising walls defining two cavities (1; 2), each provided with an aperture (11; 21) shut off by a loudspeaker (12; 22), noteworthy in that it is said to be "enclosed" and in that each cavity (1; 2) has a shape for which the intersection with any plane containing the central axis (X1-X1'; X2, X2') of said loudspeaker (12; 22) is a portion of an ellipse (E1*i*; E2*i*), the major axes (X1*i*-X1*i'*; X2*i*-X2*i'*) of said ellipses (E1*i*; E2*i*) being substantially coincident with said central axis (X1-X1'; X2, X2') of said loudspeaker (12; 22), said aperture (11; 21) being secant to said ellipses (E1*i*; E2*i*) in such a way that the second extreme points (P1*i'*; P2*i'*) of each ellipse (E1*i*; E2*i*) are situated in said aperture (11; 21).

7 Claims, 2 Drawing Sheets

(56) References Cited

U.S. PATENT DOCUMENTS

| | | | | |
|---|---|---|---|---|
| 4,057,689 | A | 11/1977 | Stallings, Jr. | |
| 4,964,482 | A | 10/1990 | Meyer | |
| D451,085 | S | 11/2001 | Masui | |
| 2002/0114485 | A1 | 8/2002 | Ohira et al. | |
| 2006/0269092 | A1 * | 11/2006 | Kokubo et al. | 381/386 |

FOREIGN PATENT DOCUMENTS

| | | | | |
|---|---|---|---|---|
| DE | 4227696 | A1 | | 2/1994 |
| DE | 202005012695 | U1 | | 10/2005 |
| EP | 1120992 | A2 | | 8/2001 |
| FR | 2379964 | A1 | | 9/1978 |
| GB | 887571 | A | | 1/1962 |
| GB | 2428532 | A | * | 1/2007 |
| JP | 2001078285 | A | | 3/2001 |

OTHER PUBLICATIONS

Colloms & Darlington, "7-The Enclosure" In: Colloms: "High Performance Loudspeakers, 6e edition", Jan. 1, 2005, John Wiley and Sons, pp. 361-403, 361-365, 369, 371, 376-377.

Vanderkooy, et al, "The Acoustic Center: A New Concept for Loudspeakers at Low Frequencies", AES Convention 121: October 5-8 2006, AES, 60 East 42nd Street, Room 2520 New York, USA, Oct. 1, 2006.

Vanderkooy, et al, "The Low-Frequency Acoustic Center: Measurement, Theory, and Application", AES Convention 128; May 22-25, 2010, AES, 60 East 42nd Street, Room 2520 New York, 10165-2520, USA, May 1, 2010.

Jacobsen Finn, et al, "A note on the concept of acoustic centera", The Journal of the Acoustical Society of America, American Institute of Physics for the Acoustical Society of America, New York, NY, US, vol. 115, No. 4, Apr. 1, 2004, pp. 1468-1473.

* cited by examiner

HIGH FIDELTY ELECTRO-ACOUSTIC ENCLOSURE AND METHOD OF MANUFACTURE

FIELD OF THE INVENTION

The present invention relates to a high fidelity electro-acoustic enclosure and the method of manufacture thereof.

PRIOR ART

Enhancement of the musical reproducibility of electro-acoustic enclosures has always been sought. Routinely, electro-acoustic enclosures are referred to as "two-channel" or "three-channel", wherein each channel consists of one or a plurality of electromagnetic transducers, referred to as "loudspeakers", and a cavity, referred to as a "load" forming the seat at the rear of the loudspeaker which is attached to the front wall sealing the load. The size, volume, geometry and surface condition of the load are adapted according to the range of frequencies sought and the performances to be achieved. In this way, the channel or "woofer" stage is envisaged to reproduce frequencies between approximately 20 and 600 Hz, the "midrange" stage is envisaged to reproduce frequencies between approximately 500 and 10,000 Hz and the "tweeter" stage is envisaged to reproduce frequencies from approximately 8000 Hz and, in principle, above 20,000 Hz.

The body of the electro-acoustic enclosure defining the load is generally made of wood-based panels, for example of the midrange. During the operation of the electro-acoustic enclosures, alternating or periodic movements of the loudspeaker membranes induce the vibration of the loudspeaker supports and panels. These vibrations interfere with the sound transmitted by the electro-acoustic enclosure and impair the faithful reproduction of recorded music. This impairment is particularly detrimental in that the surface area of the panels is greater than that of the loudspeaker membrane. The parasitic vibration transmission surface areas area is this greater than that of the membranes. According to the mechanical properties of the panels and the assembly method thereof, the natural frequency of the panels may consist of an excitation frequency of each loudspeaker membrane. This untimely coupling of frequencies thus creates a resonance mode, impairing the acoustic reproduction quality. These vibratory phenomena are well-known as the "enclosure signature" and generate intermodulation distortions preventing the faithful reproduction of the signals transmitted by the loudspeakers.

Moreover, besides the vibration of the walls of the acoustic enclosure, it is known that the back wave is reflected onto said walls and emerges toward the front of the enclosure, generating further distortions.

Some manufacturers have attempted to minimize the "enclosure signature" problem, particularly by stiffening the panels, for example using sandwich type panels made of a crisscross fiber base, assembled by gluing and connected with transverse stiffeners.

The publication CN 2 274 853 describes an electro-acoustic enclosure comprising assembled panels, wherein each panel is made of flat natural stone.

The publication CN 2 371 745 describes an electro-acoustic enclosure comprising assembled panels, wherein each panel is made of stone such as, in particular, carnelian, granite or marble to limit the parasitic effects of wall resonance.

The publication CN 2 284 477 also describes an electro-acoustic enclosure comprising assembled panels, wherein each panel is made of stone to obtain a pure, clean, rich and high-quality sound.

Finally, the publication DE 10 111 129 describes an electro-acoustic enclosure wherein the walls are flat or curved and consist of wood, stone, metal, plastic or artificial stone.

Despite the different techniques used, these electro-acoustic enclosures are not suitable for obtaining a sufficiently low "enclosure signature" to obtain a high-quality sound.

Besides the materials used and the surface condition of the load, it is known that the performances of the enclosure are also dependent on the volume and shape of the cavity acting as the load, the geometry and size of the vents in the case of a "bass reflex" enclosure.

Since the work by some pioneers such as Neville THIELE, Sigfried LINKWITZ, Garry MAGOLIS and Richard H. SMALL who laid the foundations of electro-acoustics, software has been developed to determine, in an optimum manner, the volume and geometry of vents, for bass reflex enclosures, based on the characteristics of the loudspeakers.

In respect of the geometry of the cavity, it is recognized that the parallelism of the internal walls of the cavity is propitious for the formation, in the cavities, of parasitic instationary wave and stationary wave trains. The presence of these vibration modes affects the movement of the membranes by generating intermodulation distortions and interferences, preventing the electro-acoustic enclosure from achieving an optimal audio signal reproduction level. Also, to prevent the parasitic emissions generated by the parallel walls, modifying the surface conditions of the internal walls of the cavities, for example randomly, to scramble the acoustic waves transmitted at the rear of the membrane and thus limit the problem, has been envisaged.

A first technique consists of forming surface irregularities by randomly hollowing the internal wall of the cavity.

In particular, from the publication CN 2 279 755, an integral electro-acoustic enclosure made of stone is known, wherein the load has an irregular surface in order to reduce parasitic vibrations and resonances.

The publication JP 8 275 283 describes an electro-acoustic enclosure formed by hollowing a stone by means of a rounded tool forming a random rough internal surface to limit wall resonance.

However, the experiments conducted with this type of electro-acoustic enclosure were not satisfactory.

A further technique, used by some electro-acoustic enclosure manufacturers, consists of providing, inside the cavity, liners, for example corrugated, such as foam, for example made of low-density compact synthetic foam intended to partially absorb or diffract the energy from the waves inside the cavity.

The solutions are nonetheless not satisfactory.

Moreover, it was demonstrated that cavities having non-parallelepipedic shapes were suitable for significantly reducing the parasitic phenomena associated with the waves generated by the parallel walls of conventional electro-acoustic enclosures.

The prior art particularly includes the publication DE 8 222 350 describing an electro-acoustic enclosure wherein the wall is formed from natural stone gravel bound with a resin, the electro-acoustic enclosure having a spherical shape.

The publication DE 4 227 696 describes an electro-acoustic enclosure comprising two hemispherical shapes assembled together and wherein the walls are made of concrete.

The publication CN 2 489 531 describes an electro-acoustic enclosure wherein the external appearance simulates that of a natural stone and wherein the internal walls have an irregular surface condition and are not parallel with each other.

The various geometries tested are nonetheless not suitable for achieving a satisfactory acoustic reproduction level.

The aim of the present invention is that of remedying these drawbacks by providing a high fidelity electro-acoustic enclosure suitable for canceling out the "enclosure signature" and eliminating the back waves returning to the front in order to obtain ideal conditions for the faithful reproduction of recorded music.

DESCRIPTION OF THE INVENTION

The invention relates to an electro-acoustic enclosure comprising walls defining at least one cavity provided with an aperture shut off by at least one loudspeaker comprising a membrane wherein the front surface transmits a front wave and wherein the rear surface transmits a back wave, said loudspeaker thus being defined particularly by the position of the front acoustic center thereof for said front wave, by the position of the rear acoustic center thereof for said back wave and by the central axis thereof passing through the front and rear acoustic centers. Said electro-acoustic enclosure is characterized in that it is said to be "enclosed", i.e. devoid of vents and in that the shape of said cavity is such that the intersection thereof with any plane containing said central axis of said loudspeaker is at least a portion of an ellipse particularly characterized by a first focal point and a second focal point which are separate and a major axis wherein the intersection with said ellipse defines a first extreme point and a second extreme point, distributed on either side of the first and second focal points, respectively, said major axes of said ellipses being arranged so as to be substantially coincident with said central axis of said loudspeaker, said aperture being secant with said ellipses such that said second extreme points of each ellipse are situated on the other side of said aperture in relation to the cavity, in that the cavity is arranged so that said first extreme points are substantially coincident, said first focal points are substantially coincident, and at least a portion of said second focal points are distant, and in that said loudspeaker and said cavity are arranged so that said rear acoustic center of said loudspeaker is situated between said second focal points furthest from each other of said ellipses forming said cavity or coincident with one of said second focal points furthest from each other.

Due to this particular arrangement, the acoustic back waves cannot emerge and are trapped by a phenomenon which can be described as an "acoustic black hole".

The electro-acoustic enclosure according to the invention is thus suitable for achieving unrivalled sound reproduction quality. Indeed, only the waves transmitted by the front surface of the loudspeaker membrane are output by the electro-acoustic enclosure. The rear acoustic center of the loudspeaker being framed by the variation range of the second focal points of all the ellipses characterizing the geometry of the cavity, the waves transmitted by the rear surface of the loudspeaker membrane, after reflection on the walls of the cavity, converge toward the first single focal point. In this way, the parasitic waves transmitted by the rear surface of the membrane are trapped and eventually disappear by means of internal viscosity frictions between the air molecules contained in the cavity, without degrading the sound transmitted by the front surface of the loudspeaker membrane of the electro-acoustic enclosure.

According to one preferential embodiment, the shape of said cavity is a revolving ellipsoid such that all the ellipses are identical and the first focal points thereof, the second focal points thereof, the first extreme points thereof and the second extreme points thereof are substantially coincident, and in that said loudspeaker and said cavity are arranged such that the median position of said rear acoustic center of said loudspeaker is substantially coincident with the second focal points of said ellipses.

Said walls of said cavity are preferably integral and made of a material wherein the density is greater than 1600 kg/m$^3$ by molding and/or machining.

Said material constituting the block forming said walls of said cavity is advantageously heterogeneous and cohesive.

According to a preferential embodiment, said walls of said cavity are made of a dense and homogeneous material such as plaster, cement and some plastics.

According to a further preferential embodiment, said walls of said cavity are made of a metallic material.

The electro-acoustic enclosure preferably comprises at least one first and one second cavity.

BRIEF DESCRIPTION OF THE FIGURES

Further advantages and features will emerge more clearly from the description hereinafter with reference to the appended figures wherein.

OPTIMUM EMBODIMENT OF THE INVENTION

The remainder of the description is based on a two-channel electro-acoustic enclosure. It is obvious that the invention is applicable to any type of electro-acoustic enclosure, regardless of the number of channels.

Figure 1:
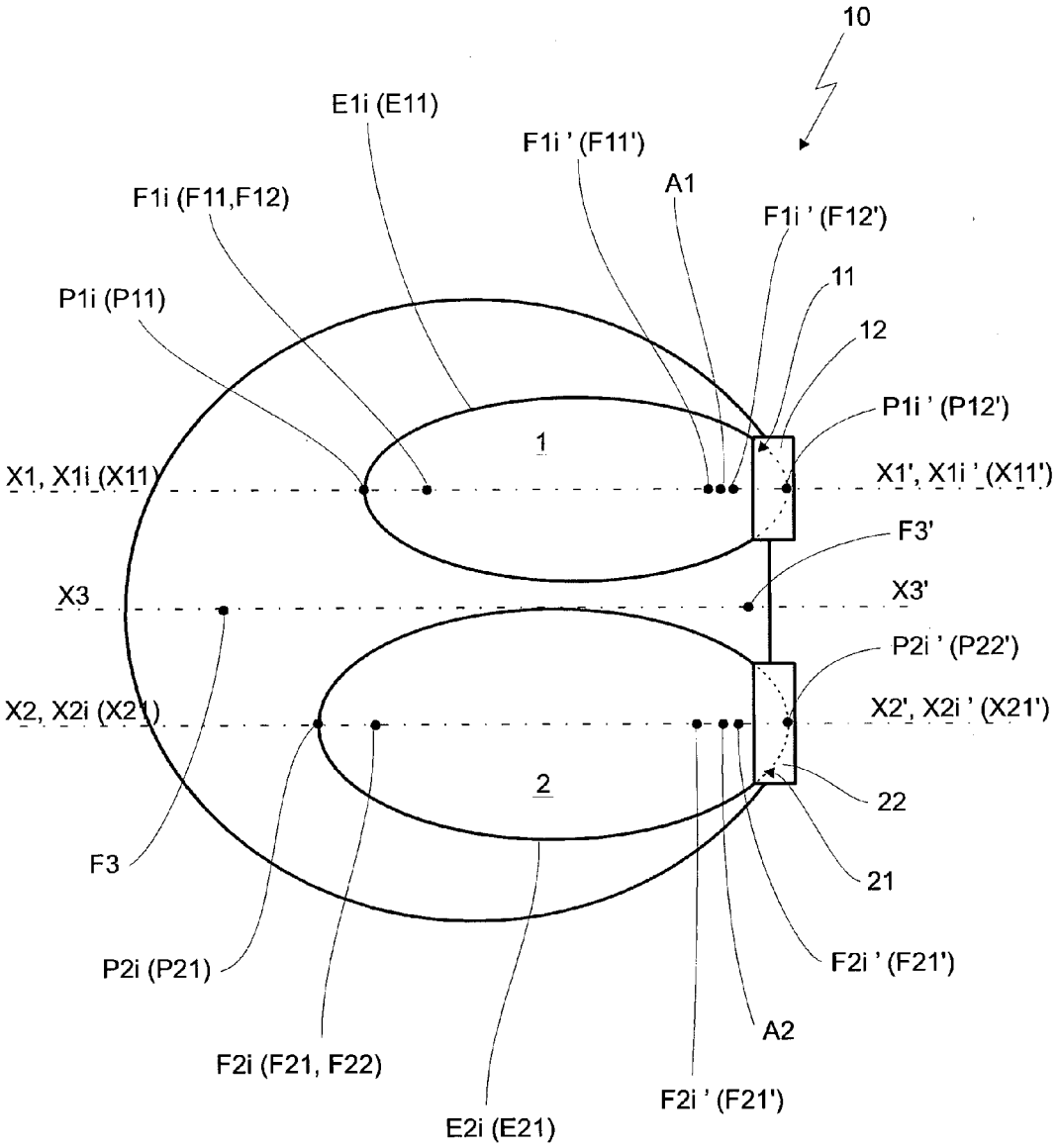
FIG. 1 is a schematic sectional view of an electro-acoustic enclosure according to the invention.

With reference to FIG. 1, the electro-acoustic enclosure 10, according to the invention, comprises a first cavity 1 and a second cavity 2, preferably made from a single block of solid material. Each first and second cavities 1, 2, is provided with an aperture 11, 21, shut off respectively by a first loudspeaker 12 and a second loudspeaker 22. In one alternative embodiment not shown, the electro-acoustic enclosure is formed by assembling blocks, each block corresponding to a channel of the electro-acoustic enclosure and comprising at least one cavity shut off by at least one loudspeaker. As illustrated, this electro-acoustic enclosure 10 is preferably referred to as "enclosed", i.e. devoid of vents.

The first loudspeaker 12 (or electrodynamic transducer) comprises a membrane wherein the front surface transmits a front wave and wherein the rear surface transmits a back wave. The first loudspeaker 12 is thus characterized particularly by the front acoustic center thereof, the rear acoustic center A1 thereof and by the central axis X1-X1' thereof, passing through the front and rear acoustic centers A1 of the first loudspeaker 12. The second loudspeaker 22 (or electrodynamic transducer) also comprises a membrane wherein the front surface transmits a front wave and wherein the rear surface transmits a back wave. The second loudspeaker 22 is thus characterized particularly by the front acoustic center thereof, the rear acoustic center A2 thereof and by the central axis X2-X2' thereof, passing through the front and rear acoustic centers A2 of the second loudspeaker 22.

The front acoustic center of a loudspeaker is known to those skilled in the art. Indeed, it is well known that an acoustic wave is a local variation of the pressure due to the propagation of an overall movement of air molecules and that each spherical wave has an acoustic center which is the spatial point situated at the origin of said acoustic wave. By way of analogy with waves on the water surface of a pool, the center of the wave is the point where a stone was thrown into the water. Particular reference may be made to the article by John Vanderkooy "The Acoustic Center: A New Concept for Loudspeakers at Low Frequencies" published in the AES Convention Paper 6912, 121st Convention dated Oct. 5-8, 2006.

Moreover, each surface element of the membrane of the first and second loudspeakers 12, 22, respectively shutting off the first and second cavities 1, 2 of the electro-acoustic enclosure 10, when moving, pushes air on one side and draws it in on the other and vice versa, thus creating a front wave and a back wave generated on either side of said membrane, each of said front and back waves being different and each having a specific acoustic center thereof, i.e. the front acoustic center and the rear acoustic center A1, A2, respectively. These two front and rear acoustic centers A1, A2 determine the central axis X1,X1', X2,X2' of said loudspeaker 12, 22.

Figure 2:
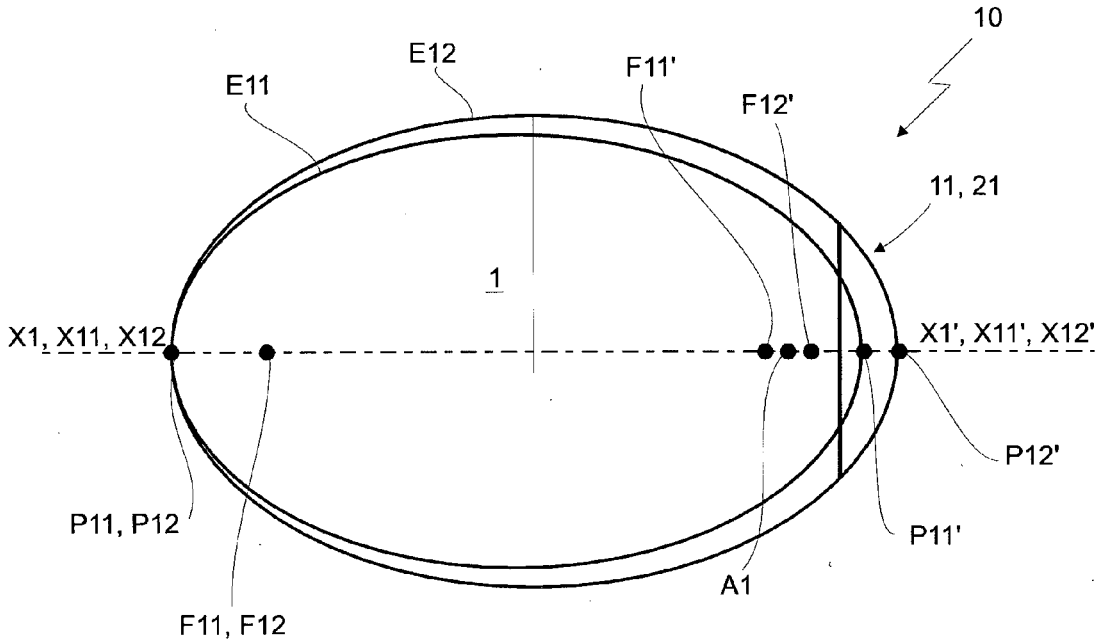
FIG. 2 is a schematic view illustrating the shape of the cavity of the electro-acoustic enclosure according to the invention, wherein the vertical and horizontal section planes are reduced to the same plane, and the aperture of the electro-acoustic enclosure are represented by a vertical line.

Furthermore, in respect of the determination of the front and rear acoustic centers A1, A2, it is well known to those skilled in the art that it is necessary to isolate the front wave in relation to the back wave using tubes at the end thereof is a suitable impedance (without reflection), and to find an isopressure surface experimentally. This gives a sphere wherein the center is the acoustic center of the front wave. A similar method should be followed to determine the rear acoustic center A1, A2. Finally, it is well known to those skilled in the art that the position of the front and rear centers A1, A2 varies slightly according to the sound frequency. The geometry of the first cavity 1 is particularly characterized in that the intersection thereof with any plane containing the central axis X1-X1' of the first loudspeaker 12 is a portion of an ellipse E1*i*. In this way, the intersection with a first plane containing the central axis X1-X1' of the first loudspeaker 12 is a portion of an ellipse E11. FIG. 2 is thus suitable for illustrating the two portions of ellipses E11 and E12 obtained by intersecting the first cavity 1 with separate first and second section planes, for example a vertical section plane and a horizontal section plane.

As seen in FIG. 2 and FIG. 1, wherein a portion of the ellipse E11 is represented as a dotted line:

- the ellipse E11 is particularly characterized by the first focal point F11 thereof, the second focal point F11' thereof and the major axis X11-X11' thereof wherein the intersection with the ellipse E11 defines the first extreme point P11 and the second extreme point P11', the first and second extreme points P11, P11' being distributed on either side of the first and second focal points F11 and F11', respectively,
- the ellipse E12 is particularly characterized by the first focal point F12 thereof, the second focal point F12' thereof and the major axis X12-X12' thereof wherein the intersection with the ellipse E12 defines the first extreme point P12 and the second extreme point P12', the first and second extreme points P12, P12' being distributed on either side of the first and second focal points F12 and F12', respectively.

The first focal point F11 of the ellipse E11 is distant from the second focal point F11' of the same ellipse E11. Furthermore, the major axis X11-X11' of the ellipse E11 is substantially coincident with the central axis X1-X1' of the loudspeaker 12. Similarly, the first focal point F12 of the ellipse E12 is distant from the second focal point F12' of the same ellipse E12. Furthermore, the major axis X12-X12' of the ellipse E12 is substantially coincident with the central axis X1-X1' of the first loudspeaker 12. The term "substantially coincident" herein denotes that the tolerance of the lateral alignment and angular alignment of the major axis X11-X11' of the ellipse E11 in relation to the central axis X1-X1' of the loudspeaker 12 is defined by the maximum precision allowed by the machine used by those skilled in the art to carry out this operation. The same applies for the major axis X12-X12' of the ellipse E12. The aperture 11 is secant with the ellipses E11, E12 such that the second extreme points P11', P12' are situated on the other side of the aperture 11 suitable for receiving the first loudspeaker 12 in relation to the cavity 1 according to FIGS. 1 and 2. The second extreme points P11', P12' are thus virtual points shown in the figures for the purposes of comprehension of the shape of the first cavity 1.

As seen in FIGS. 1 and 2, the first focal points F11, F12 of the ellipses E11, E12 are substantially coincident and the second focal points F11', F12' of the ellipses E11, E12 are distant. Furthermore, the rear acoustic center A1 of the first loudspeaker 12 is situated between the second focal points F11' and F12' of the ellipses E11, E12, respectively.

As described above, the rear acoustic center A1 has a variable position dependent on the sound frequency. In this way, the position of the rear acoustic center A1 varies along a segment of the central axis X1-X1' of the loudspeaker 12 wherein the ends correspond to the positions of the rear acoustic center A1 for the lowest frequency and for the highest frequency. One of the features of the invention is such that said segment of the central axis X1-X1' is situated between the second focal points furthest from each other, i.e. the second smallest second focal point of said ellipses E1*i* of the first cavity 1 and the largest second focal point of said ellipses E1*i* of the first cavity 1.

The term "small ellipse" denotes an ellipse wherein the first and second extreme points are the closest and conversely "large ellipse" denotes an ellipse wherein the first and second extreme points are the furthest.

Figure 3:
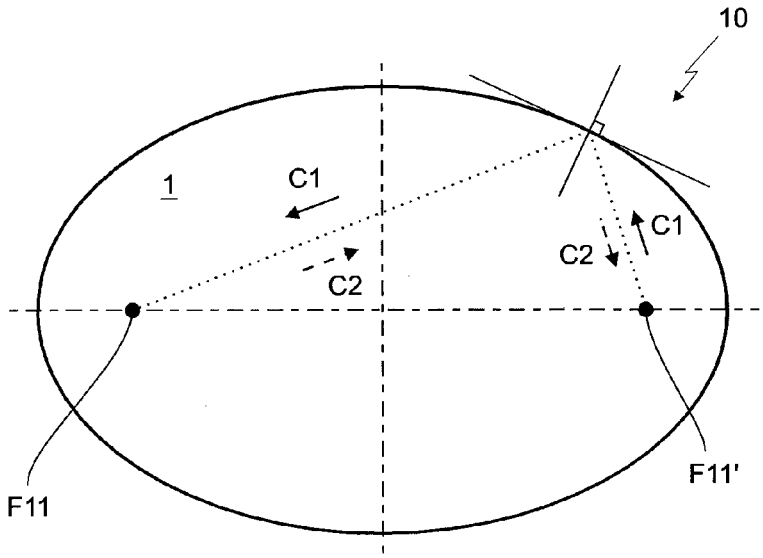
FIG. 3 is a schematic sectional view of the cavity of the electro-acoustic enclosure illustrating the "acoustic black hole" phenomenon whereby the parasitic waves circulate, after reflections by the walls in both directions of circulation represented using arrows, between the first focal point and the second focal point of each specific ellipse defining the cavity of the electro-acoustic enclosure.

In this way, according to the previous explanations and with reference to FIG. 3, the waves transmitted by the rear surface of the membrane of the first loudspeaker 12 are trapped in the first cavity 1 by a so-called "acoustic black hole" phenomenon, associated with the properties of the ellipses E1*i* of the cavity 1. The parasitic waves move between the first focal points F11 and the second focal points F11', in both directions of circulation represented using the arrows C1 and C2, bouncing against the walls of the first cavity 1. These parasitic waves are eventually attenuated, by means of the internal viscosity frictions between the air molecules contained in the cavity, following the repeated reflections thereof, without degrading the sound transmitted via the front of the membrane of the first loudspeaker (not shown in FIG. 3) of the electro-acoustic enclosure 10.

Consequently, it is clear that it is important that the first cavity 1 is "enclosed", i.e. devoid of vents, since the entire aim of the invention is that of eliminating said enclosure signature and the back waves returning to the front of the enclosure in an essentially geometric manner by "trapping" the back wave inside the first cavity 1.

With reference to FIG. 1, the geometry of the second cavity 2 is comparable to that of the first cavity 1. In this way, the intersection thereof with any plane containing the central axis X2-X2' of the second loudspeaker 22 is a portion of an ellipse E1*i* such as the ellipse E21 shown. The ellipse E21 is defined by the first focal point F21 thereof, the second focal point F21' thereof and the major axis X21-X21' wherein the intersection with the ellipse E21 defines the first extreme point P21 and the second extreme point P21', the first and second extreme points P21, P21' being distributed on either side of the first and second focal points F21 and F21', respectively. The first focal point F21 of the ellipse E21 is distant from the second focal point F21' of the same ellipse E21. The same applies for the first focal points F2*i* and the second focal points F2*i'* of the other ellipses E2*i* defining the second cavity 2. Furthermore, the major axis X21-X21' of the ellipse E21 is substantially coincident with the central axis X2-X2' of the second loudspeaker 22. The term "substantially coincident" herein denotes that the tolerance of the lateral alignment and angular alignment of the major axis X21-X21' of the ellipse E21 in relation to the central axis X2-X2' of the loudspeaker 12 is defined by the maximum precision allowed by the machine used by those skilled in the art to carry out this operation. The same applies for the major axis X2*i*-X2*i'* of the other ellipses E2*i* defining the second cavity 2. The second extreme points P2*i'*, are thus virtual points, including the second extreme point P22, shown in FIG. 1 for the purposes of comprehension of the shape of the second cavity 2. The first focal points F2*i* (including the first focal point F21) of the ellipses E2*i* (including the ellipse E21) are substantially coincident, and the second focal points F2*i'* of the ellipses E21 are distant. Furthermore, the rear acoustic center A2 of the second loudspeaker 22 is situated between the second focal points F2*i'* of the ellipses E2*i*.

As for the first cavity 1, the rear acoustic center A2 has a variable position dependent on the sound frequency. In this way, the position of the rear acoustic center A2 varies along a segment of the central axis X2-X2' of the loudspeaker 22 wherein the ends correspond to the positions of the rear acoustic center A2 for the lowest frequency and for the highest frequency. One of the features of the invention is such that said segment of the central axis X2-X2' is situated between the second focal points furthest from each other, i.e. the second smallest second focal point of said ellipses E1*i* of the second cavity 2 and the largest second focal point of said ellipses E2*i* of the second cavity 2.

In this way, as for the first cavity 1, the parasitic waves are trapped in the second cavity between the coincident first focal points F2*i* and the second focal points F2*i'* wherebetween they are eventually attenuated, by means of the internal viscosity frictions between the air molecules contained in the cavity, following repeated bouncing against the walls of the second cavity 2. The sound transmitted by the front surface of the membrane of the second loudspeaker 22 of the electro-acoustic enclosure 10 is thus not impaired by these parasitic waves.

In this example, the electro-acoustic enclosure 10 has an outer shape corresponding at least partially to an ellipsoid, particularly characterized by the first focal point F3 thereof and the second focal point F3' thereof which are distant, and by the major axis X3-X3' thereof. This ellipsoid is, preferably, a revolving ellipsoid.

The single material block is preferably a block wherein the density is greater than 1600 kg/m3. For example, a heterogeneous and cohesive material such as natural stone or ceramic, for example, is chosen. For example, it is possible to use natural rocks with a solid texture with no orientation, particularly biodetric limestones, oolitic limestones, metamorphic limestones wherein the density is between approximately 1600 kg/m3 and 2900 kg/m3. It is also possible to use a trachyandesite, i.e. an alkaline series intraplate volcanic rock, intermediate between a trachybasalt and a trachyte. These materials are the result either of the differentiation of alkaline basalts by fractional crystallization, or of mixtures between alkaline basalt and trachyte or rhyolite. These materials consisting of limestone sediments, optionally recombined under the effect of geological disruptions, offer a cohesive structure of heterogeneous compounds with properties enabling said compounds to behave in a completely neutral manner in respect of the direct excitation of the sound transmissions produced by the loudspeakers.

This neutrality is explained by the apparent porosity of the stone, consisting of the population density and the geometry of the microscopic cavities on the surface thereof and wherein the properties, covered by the term "tortuosity", produce diffraction of the acoustic waves and attenuation of the vibration energy penetrating the stone mass. Indeed, the diffraction of the acoustic waves in the small cavities forming the porosity thereof, combined with the very significant difference between the compression and tensile Young's moduli of the stone, explains why the excitation energy of the waves transmitted by the rear of the membrane do not generate volume waves, i.e. waves transmitted by the solid stone. In this way, the vibrations induced by the acoustic waves in each first and second cavities 1, 2, are not transmitted in the stone mass. The absence of volume waves in the solid stone gives rise to the absence of vibrations of the outer surfaces of the walls of the acoustic enclosure 10, thus preventing the "enclosure signature" problem, i.e. the transmission of parasitic acoustic waves. The incident energy of the acoustic waves transmitted by the rear of the membrane of the loudspeaker 12, 22 remains on the inner surface of the stone cavity 1, 2, in the form of evanescent volume waves. Satisfactory results have particularly been obtained using so-called "SAINT-RAPHAEL" stone wherein the density is 2340 kg/m3 and wherein the apparent porosity is 12.03%. Superior results have also been obtained using "FOUSSANA" limestone marble wherein the density is in the region of 2600 kg/m3 and wherein the apparent porosity is in the region of 3%. Indeed, with "FOUSSANA" limestone marble, it was observed that the frequency amplitude response curves were more regular than those obtained with "SAINT-RAPHAEL" stone.

The absence of an "enclosure signature", i.e. the vibratory neutrality obtained with natural solid stone, may also be obtained by means of the inertia of other materials such as dense and homogeneous materials such as, for example, plaster, cement and some plastics. A block made of metallic materials such as, for example, steels, cast irons, lead, copper, bronze, brass, silver, uranium or any suitable alloy wherein the density is close to or considerably greater than that of natural stone may also be advantageously chosen.

In one alternative embodiment not shown, the cavities may be shut off by a plurality of loudspeakers.

To manufacture electro-acoustic enclosures 10 according to the invention, a method of manufacture is implemented whereby the number of cavities 1, 2 required is provided by hollowing the front of the material block. This operation may advantageously be performed using industrial tools such as numerically controlled machines, "five-axis" machines for example. With the same production means, it is possible to produce the external ellipsoid of the electro-acoustic enclosure 10. When the cavities 1, 2 are produced from materials suitable for being molded, the cavities may be manufactured by molding.

The technical features of the electro-acoustic enclosure 10 according to the invention are suitable for producing an acoustic seal suitable for preventing the formation of stationary waves in the first cavity 1 and in the second cavity 2, stationary waves that would interfere with the movement of the membrane of the loudspeakers 12, 22 and would create adverse vibratory interference.

DESCRIPTION OF FURTHER EMBODIMENTS

According to one preferential embodiment not shown, the shape or geometry of the first cavity 1 is a revolving ellipsoid. In this way, the intersection of the first cavity 1 with any plane containing the central axis X1-X1' of the first loudspeaker 12 is a portion of an ellipse E1*i* and the intersection of the first cavity 1 with any plane perpendicular to the central axis X1-X1' of the first loudspeaker 12 is a circle.

All the ellipses E1*i* are particularly characterized by the first and second focal points thereof at a distance from each other and the major axis thereof wherein the intersection with the ellipses E1*i* defines the first extreme point thereof and the second extreme point thereof, the first and second extreme points being distributed on either side of the first and second focal points F11 and F11', respectively.

In the case of a revolving ellipsoid, all the ellipses E1*i* are identical and thus all the first focal points are substantially coincident, all the second focal points are substantially coincident, all the first extreme points are substantially coincident and all the second points are substantially coincident.

In this particularly advantageous configuration for obvious reasons in respect of simplicity of manufacture and implementation, the rear acoustic center A1 of the loudspeaker 12 is situated such that the median position thereof is substantially coincident with the second focal point of the ellipses E1*i*.

The term "median position" denotes herein the midpoint of the segment of the central axis X1-X1' of the loudspeaker 12 wherein the end correspond to the positions of the rear acoustic center A1 for the lowest frequency and for the highest frequency.

Moreover, the term "substantially coincident" herein denotes that the tolerance of said position is defined by the maximum precision allowed by the machine used by those skilled in the art to carry out this operation.

In the case of a multi-channel electro-acoustic enclosure, it is obvious that the other cavities will have the same geometric features.

INDUSTRIAL APPLICABILITY

The electro-acoustic enclosure 10 according to the invention may be used for any type of sound installation, by personal, professional and/or industrial users. Moreover, the electro-acoustic enclosure 10 according to the invention may be manufactured using a suitable industrial method in respect of the variable scale of the needs to be met.

Obviously, the example described is merely one particular illustration, which is in no way limiting, of the scope of application of the invention. Those skilled in the art would be able to make enhancements in respect of size, shape and material to the particular example of an embodiment and to the method of manufacture without leaving the scope of the present invention.

The invention claimed is:

1. Electro-acoustic enclosure (10) comprising walls defining at least one cavity (1; 2) provided with an aperture (11; 21) shut off by at least one loudspeaker (12; 22) comprising a membrane wherein the front surface transmits a front wave and wherein the rear surface transmits a back wave, said loudspeaker (12; 22) thus being defined particularly by the position of the front acoustic center thereof for said front wave, by the position of the rear acoustic center (A1; A2) thereof for said back wave and by the central axis (X1-X1'; X2-X2') thereof passing through the front and rear acoustic centers (A1; A2) wherein said electroacoustic enclosure (10) is sealed and devoid of vents and in that the shape of said cavity (1; 2) is such that the intersection thereof with any plane containing said central axis (X1-X1'; X2,X2') of said loudspeaker (12; 22) is at least a portion of an ellipse (E1*i*; E1*i*) particularly characterized by a first focal point (F1*i*; F2*i*) and a second focal point (F1*i*'; F2*i*') which are separate and a major axis (X1*i*-X1*i*'; X2*i*-X2*i*') wherein the intersection with said ellipse (E1*i*; E2*i*) defines a first extreme point (P1*i*; P2*i*) and a second extreme point (P1*i*'; P2*i*'), distributed on either side of the first and second focal points (F1*i*, F1*i*'; F2*i*, F2*i*'), respectively, said major axes (X1*i*-X1*i*'; X2*i*-X2*i*') of said ellipses (E1*i*; E2*i*) being arranged so as to be substantially coincident with said central axis (X1-X1'; X2,X2') of said loudspeaker (12; 22), said aperture (11; 21) being secant with said ellipses (E1*i*; E2*i*) such that said second extreme points (P1*i*'; P2*i*') of each ellipse (E1*i*; E2*i*) are situated on the other side of said aperture (11; 21) in relation to the cavity (1; 2), in that the cavity (1; 2) is arranged so that said first extreme points (P1*i*; P2*i*) are substantially coincident, said first focal points (F1*i*; F2*i*) are substantially coincident, and at least a portion of said second focal points (F1*i*'; F2*i*') are distant, and in that said loudspeaker (12; 22) and said cavity (1; 2) are arranged so that said rear acoustic center (A1, A2) of said loudspeaker (12, 22) is situated between said second focal points (F1*i*'; F2*i*') furthest from each other of said ellipses forming said cavity (1; 2) or coincident with one of said second focal points (F1*i*'; F2*i*') furthest from each other.

2. Electro-acoustic enclosure (10) according to claim 1, characterized in that the shape of said cavity (1; 2) is a revolving ellipsoid such that all the ellipses (E1*i*; E2*i*) are identical and the first focal points (F1*i*; F2*i*) thereof, the second focal points (F1*i*'; F2*i*') thereof, the first extreme points (P1*i*; P2*i*) thereof and the second extreme points (P1*i*'; P2*i*') thereof are substantially coincident, and in that said loudspeaker (12; 22) and said cavity (1; 2) are arranged such that the median position of said rear acoustic center (A1; A2) of said loudspeaker (12; 22) is substantially coincident with the second focal points (F1*i*'; F2*i*') of said ellipses (E1*i*; E2*i*).

3. Electro-acoustic enclosure (10) according to any of claims 1 or 2, characterized in that said walls of said cavity (1; 2) are integral and made of a material wherein the density is greater than 1600 kg/m$^3$ by molding and/or machining.

4. Electro-acoustic enclosure (10) according to claim 3, characterized in that said material constituting the block forming said walls of said cavity (1; 2) is heterogeneous and cohesive.

5. Electro-acoustic enclosure (10) according to claim 3, characterized in that said walls of said cavity (1; 2) are made of a dense and homogeneous material such as plaster, cement and some plastics.

6. Electro-acoustic enclosure (10) according to claim 3, characterized in that said walls of said cavity (1; 2) are made of a metallic material.

7. Electro-acoustic enclosure (10) according to claim 1, characterized in that it comprises at least one first and one second cavity (1; 2).

* * * * *